US011142293B2

(12) United States Patent
Paulic

(10) Patent No.: US 11,142,293 B2
(45) Date of Patent: Oct. 12, 2021

(54) BROACH RECOIL MECHANISM

(71) Applicant: Advanced Acoustic Concepts, LLC, Washington, DC (US)

(72) Inventor: Antonio Paulic, Westerville, OH (US)

(73) Assignee: Advanced Acoustic Concepts, LLC, Hauppauge, NY (US)

( * ) Notice: Subject to any disclaimer, the term of this patent is extended or adjusted under 35 U.S.C. 154(b) by 116 days.

(21) Appl. No.: 16/742,719

(22) Filed: Jan. 14, 2020

(65) Prior Publication Data

US 2021/0276680 A1 Sep. 9, 2021

Related U.S. Application Data

(60) Provisional application No. 62/792,773, filed on Jan. 15, 2019.

(51) Int. Cl.

| | |
|---|---|
| ***B63G 8/30*** | (2006.01) |
| ***F41C 9/06*** | (2006.01) |
| ***F41A 25/06*** | (2006.01) |
| ***F41A 25/22*** | (2006.01) |
| *B63G 8/00* | (2006.01) |

(52) U.S. Cl.

CPC ..... *B63G 8/30* (2013.01); *F41A 25/06* (2013.01); *F41A 25/22* (2013.01); *F41C 9/06* (2013.01); *B63G 2008/002* (2013.01)

(58) Field of Classification Search

CPC ..... B63G 8/30; B63G 2008/002; F41A 25/06; F41A 25/08; F41A 25/22; F41C 9/06

USPC ..... 89/14.3, 177

See application file for complete search history.

(56) References Cited

U.S. PATENT DOCUMENTS

| | | | | |
|---|---|---|---|---|
| 7,070,153 | B1 | 7/2006 | Stenard | |
| 7,926,769 | B2 | 4/2011 | Stenard | |
| 2010/0251589 | A1* | 10/2010 | Fu | F41C 9/06 42/1.14 |

FOREIGN PATENT DOCUMENTS

| | | | | |
|---|---|---|---|---|
| DE | 3002285 | A1 * | 7/1981 | F41A 1/08 |

* cited by examiner

*Primary Examiner* — Bret Hayes

(74) *Attorney, Agent, or Firm* — Kaplan Breyer Schwarz, LLP

(57) ABSTRACT

A broach recoil mechanism includes an arresting cartridge and a broach having plural cutting surfaces. The broach is disposed on the exterior of the barrel of a weapon. As a projectile is fired from the barrel, the barrel recoils, moving toward the arresting cartridge. The broach engages the arresting cartridge, shaving off pieces thereof, slowing progress of the barrel while transferring the recoil load to the hull of a unmanned underwater weapon containing the weapon.

11 Claims, 5 Drawing Sheets

BROACH RECOIL MECHANISM

STATEMENT OF RELATED CASES

This case claims priority of U.S. application Ser. No. 62/792,773 filed Jan. 15, 2019, and which is incorporated herein by reference.

FIELD OF THE INVENTION

The present invention relates to a weapon for use with underwater vehicles.

BACKGROUND

Underwater-gun systems are being developed for naval warfare. These systems often use a propellant to launch a projectile from a launch tube.

There are a variety of challenges to the development of effective underwater guns, especially those being fired from an unmanned underwater vehicle (UUV). One such challenge is managing the recoil of the gun so that it does not damage the UUV and or affect the trajectory of the projectile.

SUMMARY

Embodiments of the invention pertain to a way to prevent damage to a UUV from the recoil of an onboard weapon, and to prevent the recoil from affecting the trajectory of the projectile.

If the onboard weapon of a small, weaponized UUV includes a rigidly mounted barrel, firing a projectile from the weapon will destabilize the UUV due to recoil. In particular, yaw and/or pitching motions result due to the fluid dynamic drag of the vehicle while the projectile is still accelerating in the barrel. Such motions will unpredictably alter the trajectory of the projectile.

The illustrative embodiment of the invention is a broach recoil system that is used with a weapon having a barrel that "floats" (i.e., freely slides) along its long axis. In some embodiments, the floating barrel is contained within a UUV.

The broach recoil system is designed to engage only after a projectile exits the barrel. This permits the barrel to be thrown stably backwards in opposition to the propellant's force, mitigating any yaw or pitching motions that might otherwise occur due to firing the projectile. The projectile is therefore able to exit the barrel without applying a moment load to the UUV, assuring aim-point accuracy.

But at some time after the round exits the barrel, the barrel must come to rest, transferring a load to the UUV. For a small UUV, this load can be readily significant in terms of the mass of the UUV. In order to avoid damaging a smaller UUV, after the projectile exits the muzzle, but before the barrel comes to a hard stop, the sliding barrel engages the broach recoil mechanism. This mechanism decelerates the weapon's barrel while simultaneously accelerating the UUV. Thus, once the recoil mechanism engages, the UUV will accelerate backwards, away from the target. In order to minimize the recoil load, the recoil mechanism is design such that the barrel velocity at the end of its excursion matches the UUV's speed. Thus, this approach leverages the UUV's motion to mitigate recoil load.

In accordance with the illustrative embodiment, the recoil mechanism comprises an arresting cartridge comprising a material that is suitable for broaching, such as, without limitation, a plastic (e.g., nylon, etc.), and a broach comprising cutting surfaces that are disposed on the exterior surface of barrel. In the illustrative embodiment, the arresting cartridge is fixed in place via an arrangement that couples it to the UUV's hull or some other fixed structural feature thereof.

As previously noted, when the weapon fires, the free-floating barrel recoils. The recoil mechanism does not engage until the projectile has cleared the barrel, which occurs after 1 to 2 milliseconds, depending on muzzle velocity and barrel length. The cutting surfaces then engage the arresting cartridge, cutting into it (e.g., similar to broaching), producing fine shavings. This arrests the barrel over several inches of travel.

The recoil loading on the UUV can be tailored by adjusting the operational (stroke) distance of the recoil mechanism. Controlled deceleration minimizes the peak g-load to the UUV. The kinetic energy of the barrel is spread over a defined distance, such as a few inches.

The recoil mechanism thus prevents damage to the UUV that might otherwise occur if recoil were not mitigated prior to the barrel coming to a hard stop. The sleeve is replaced after each firing of the UUV's weapon.

BRIEF DESCRIPTION OF THE DRAWINAS

DETAILED DESCRIPTION

Embodiments of the invention are useful in conjunction with a UUV having a single-shot weapon (i.e., must be reloaded after each firing).

Figure 1A:
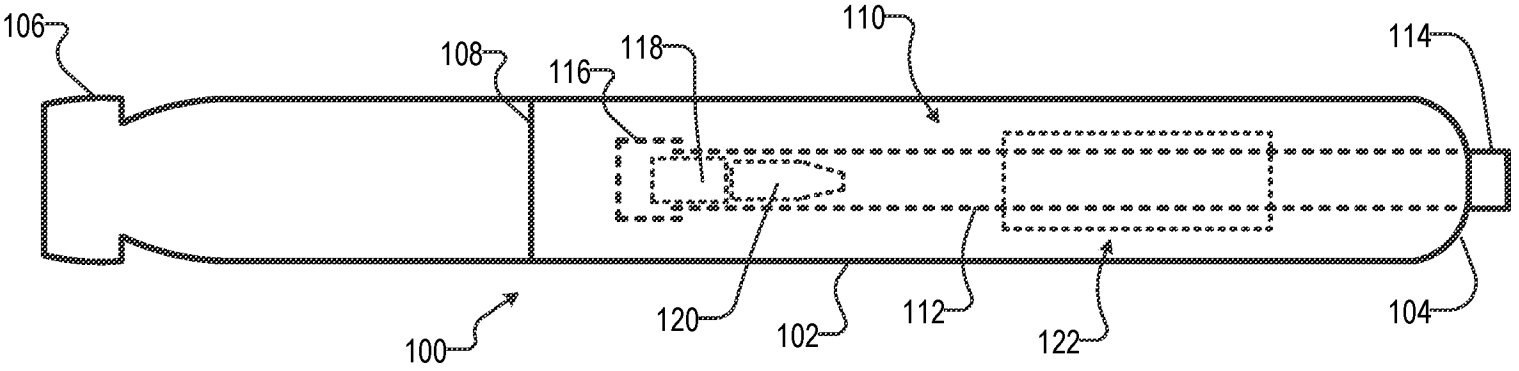
FIG. 1A depicts a first embodiment of a weaponized UUV in accordance with the illustrative embodiment including a recoil mechanism, wherein a projectile is within the barrel of the UUV's weapon.

FIG. 1A depicts an embodiment of a weaponized UUV in accordance with the illustrative embodiment of the invention. The salient features of UUV 100 depicted in FIG. 1A include hull 102, weapon 110 and recoil device 122. Weapon 110 includes barrel 112, having a muzzle 114 extending from bow 104 of the UUV. The barrel is relatively long, having a length to diameter ratio of at least about 10:1.

Weapon 110 further includes breech 116, which, in this embodiment, is disposed within the UUV. Propellant cartridge 118 and projectile 120 are disposed within breech 116 of barrel 112.

UUV 100 includes a sliding piston seal, not depicted, which supports the floating barrel and provides structural support for the barrel throughout the barrel-recoil-mechanism stroke.

Figure 1B:
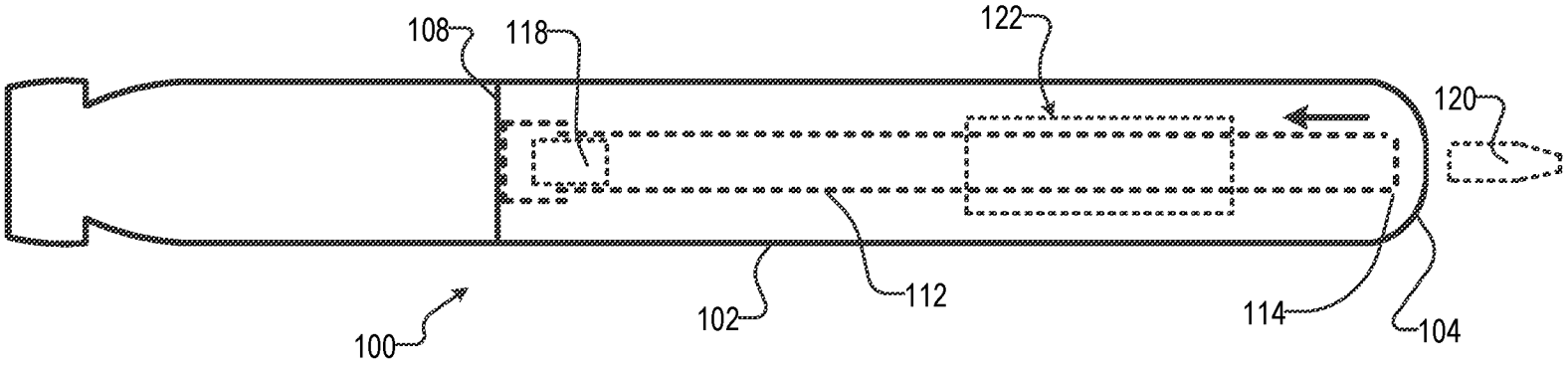
FIG. 1B depicts the weaponized UUV of FIG. 1 after the projectile is fired, showing the barrel in a post-firing location, arrested by the recoil mechanism.

FIG. 1B depicts weaponized UUV 100 after projectile 120 has fired. Barrel 112 has moved aft in UUV 100, wherein breach 116 rests against hard-stop 108.

Figure 2A:
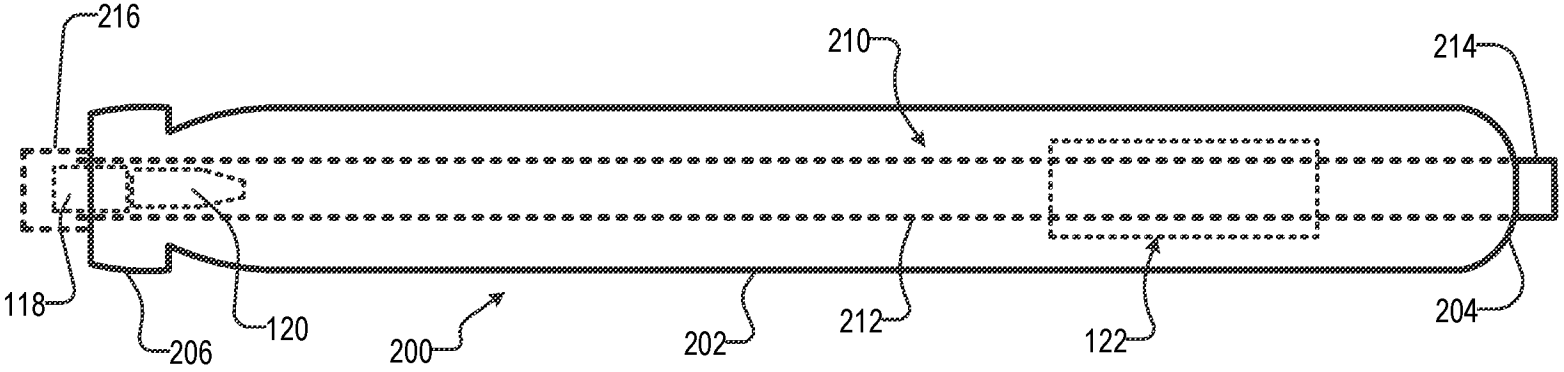
FIG. 2A depicts a second embodiment of weaponized UUV in accordance with the illustrative embodiment including a recoil mechanism, wherein a projectile is within the barrel of the UUV's weapon.

FIG. 2A depicts a second embodiment of a weaponized UUV in accordance with the illustrative embodiment of the invention. The salient features of UUV 200 depicted in FIG. 2A include hull 202, weapon 210 and recoil device 122. Weapon 210 includes barrel 212, having a muzzle 214 extending from bow 204 of the UUV.

Figure 2B:
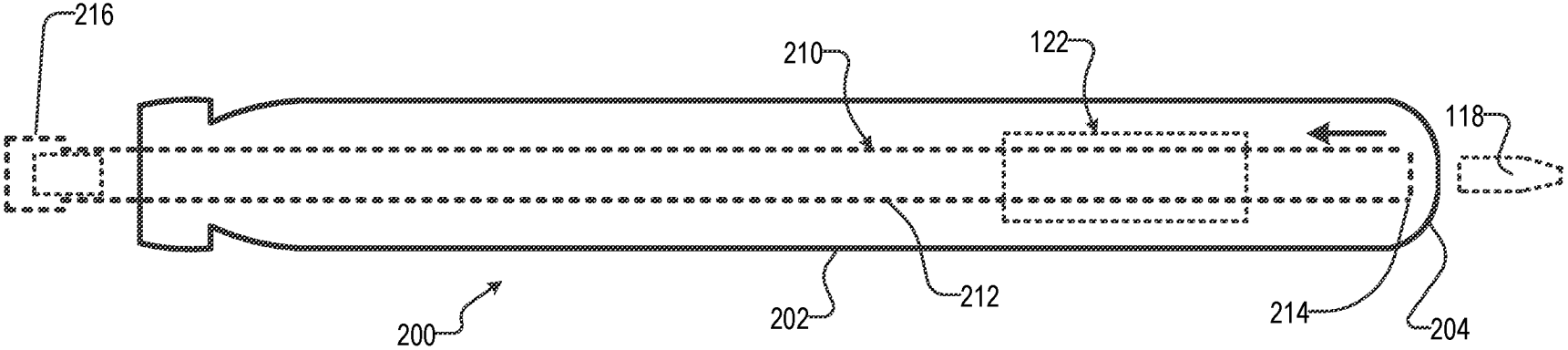
FIG. 2B depicts the weaponized UUV of FIG. 2A after the projectile is fired, showing the barrel in a post-firing location, arrested by the broach recoil mechanism.

Weapon 210 further includes breech 216. Unlike UUV 100, in which the UUV must be opened to access the breech, breech 216 is accessible from tail 206 of UUV 200. FIG. 2B depicts weaponized UUV 200 after projectile 120 has fired. Barrel 212 slides leftward (in the figure), such that breech 216 comes to rest several inches further from tail 206 than its pre-fire position.

Figure 3:
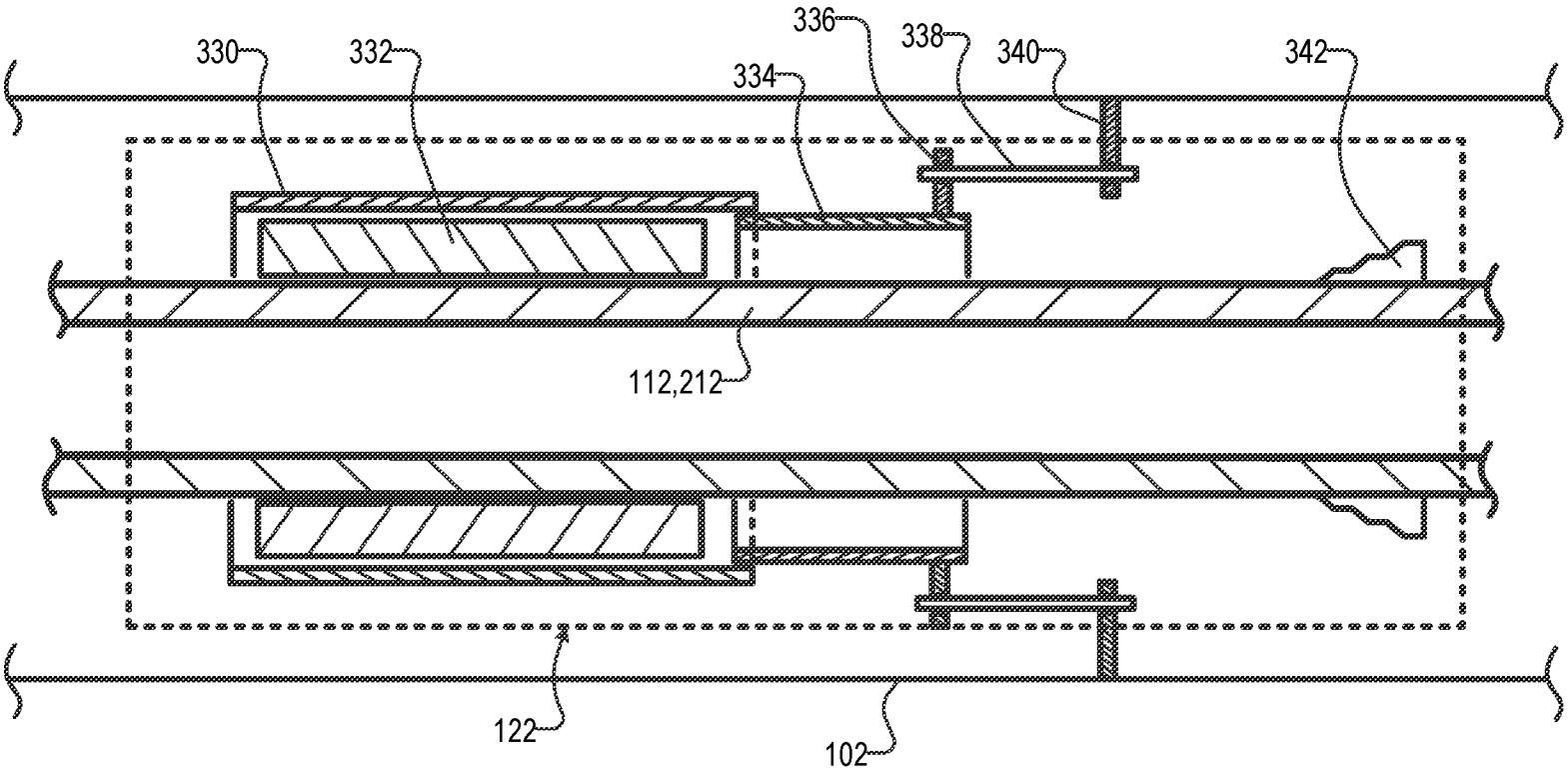
FIG. 3 depicts a cross-sectional view of a portion of the weaponized UUV of either of FIG. 1A or 2A, showing an illustrative embodiment of the broach recoil mechanism.
Figure 4C:
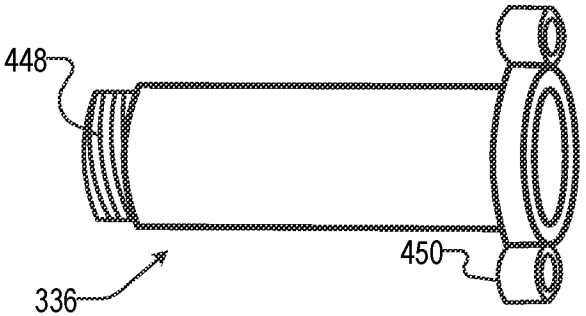
FIG. 4C depicts a perspective view of a recoil load bearing collar of the illustrative embodiment of the broach recoil mechanism.
Figure 4D:
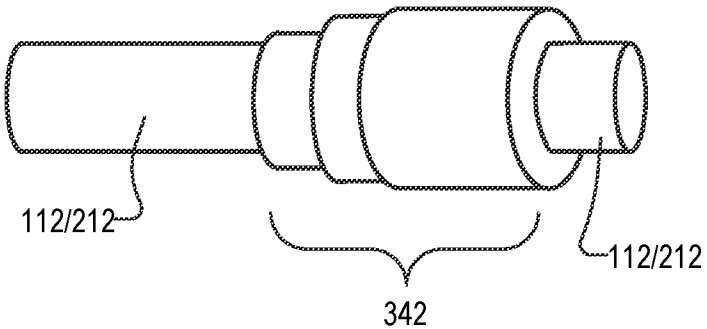
FIG. 4D depicts a perspective view of the broach disposed on the weapon's barrel in accordance with the illustrative embodiment of the broach recoil mechanism.
Figure 4A:
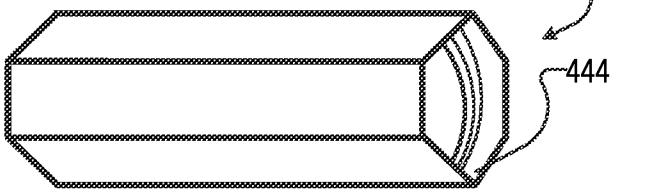
FIG. 4A depicts a perspective view of a sleeve of the illustrative embodiment of the broach recoil mechanism.
Figure 4B:
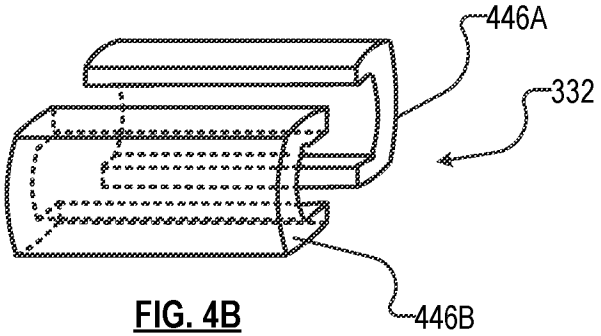
FIG. 4B depicts a perspective view of an arresting cartridge of the illustrative embodiment of the broach recoil mechanism.
Figure 4E:
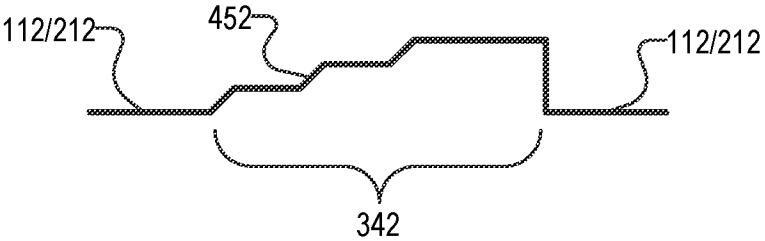
FIG. 4E depicts a side view of the broach, depicting the cutting surfaces thereof.

FIG. 3 depicts recoil mechanism 122 in accordance with the illustrative embodiment of the present invention. Recoil mechanism 122 can be used with either UUV 100 or UUV 200.

Recoil mechanism 122 includes sleeve 330, arresting cartridge 332, recoil load-bearing collar 334, and cutting surfaces or broach 342. FIGS. 4A through 4E depict views of sleeve 330, arresting cartridge 332, recoil load-bearing collar 334, broach 342, and cutting surfaces 452 of the broach.

Referring now to FIGS. 3 and 4A through 4E, sleeve 330, which in the illustrative embodiment comprises steel or titanium, receives arresting cartridge 332. In the illustrative embodiment, arresting cartridge 332 is constructed from two symmetric halves 446A and 446B. In the illustrative embodiment, the exterior surfaces of symmetric halves 446A and 446B are rounded to cooperate with the circular cross section of sleeve 330.

Recoil load-bearing collar 334 couples to sleeve 330. In the illustrative embodiment, this coupling is via a threaded engagement. To that end, the forward end of sleeve 330 is internally threaded 444 to engage threads 446 on the aft end of recoil load-bearing collar 448.

Recoil load-bearing collar 334 is coupled to the inner surface of the shell of the UUV (see, e.g., FIG. 1A: shell 102 and FIG. 2A: shell 202) or other fixed structural elements of the UUV. In the illustrative embodiment, two receivers 450 disposed at the forward end of recoil load-bearing collar 334 receive rods 338, which in turn are received by members 340.

The arrangement depicted in FIG. 3 fixes recoil mechanism 122 in place within the UUV and, during operation of the recoil mechanism, transfers the recoil load to the UUV's hull 102, 202.

Recoil mechanism 122 further includes broach 342, having cutting surfaces 352, which extend from the exterior surface of barrel 112, 212. Although cutting surfaces 352 are depicted as tapering away from the direction of movement of barrel 112/212, in some other embodiments, the cutting surfaces taper towards the direction of the barrel's movement.

When propellant in propellant cartridge 118 is ignited, projectile 120 accelerates out of barrel 112, 212 (in FIG. 3, projectile accelerates to the "right"). This causes floating barrel 112, 212 to recoil, moving "left" in FIG. 3. After barrel 112, 212 moves a specified distance to the left, cutting surfaces 352 of broach 342 on the exterior of barrel 112, 212 engage arresting cartridge 332. As cutting surfaces 352 slice through arresting cartridge 332, barrel 112, 212 decelerates and the UUV accelerates backwards.

Figure 5:
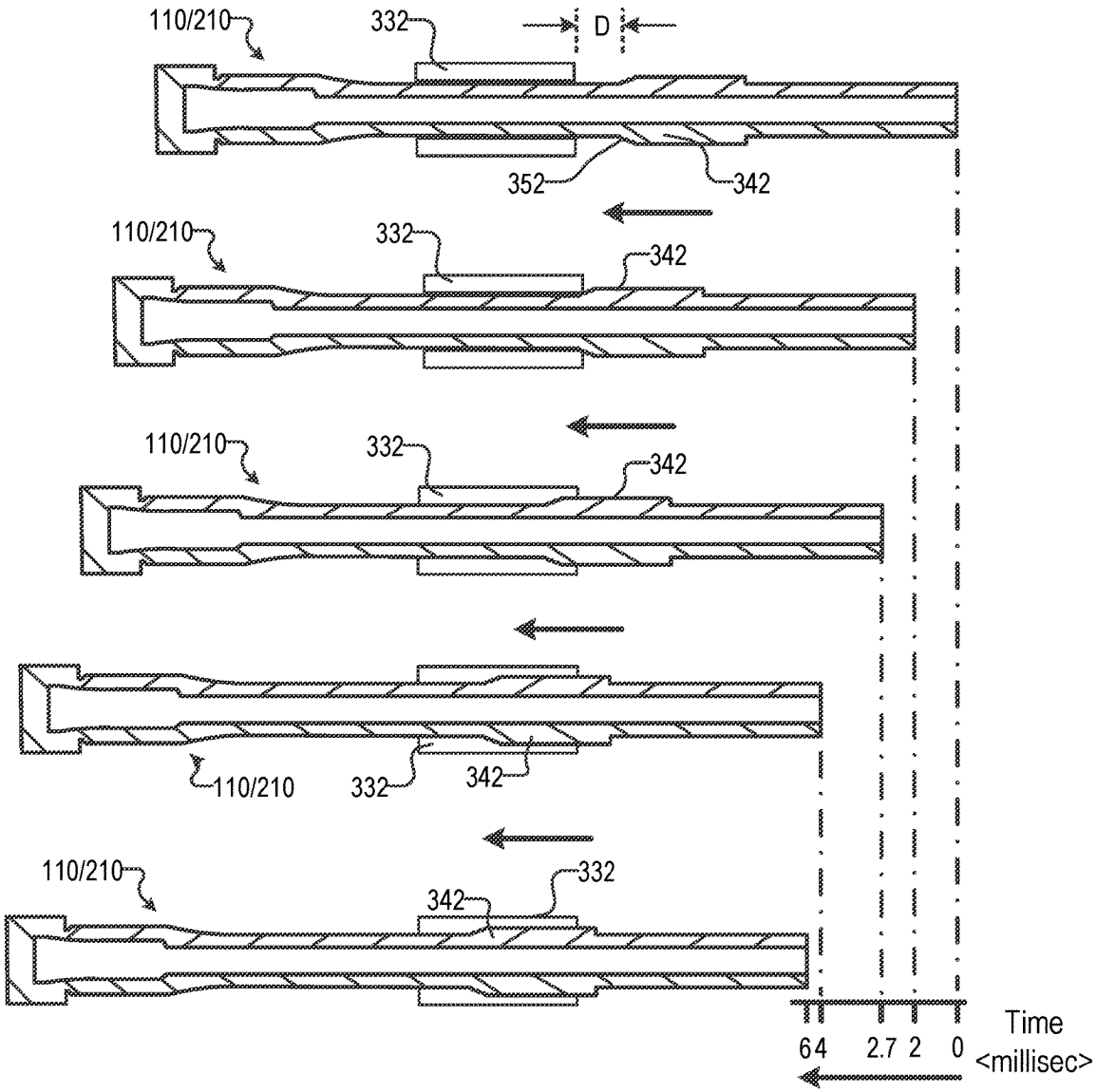
FIG. 5 depicts the operation of the broach recoil mechanism via a series of snap shots in time.

FIG. 5 depicts, sequentially, the aforementioned movement of barrel 112, 212 and engagement of broach 342 with arresting cartridge 332, as described above.

This figure depicts weapon 110/210 at five times (i.e., 0 milliseconds, 2 milliseconds, 2.7 milliseconds, 4 milliseconds, and 6 milliseconds).

Before the weapon has fired, the leading edge of cutting surface 352 of broach 342 is at a predefined distance D from arresting cartridge 332. Distance D is set so that the projectile exits the barrel before broach 342 engages arresting cartridge 332. This distance is a function of several parameters, including the projectile's mass and muzzle velocity, and the length and mass of the barrel. At a muzzle velocity of about 2000 ft/sec, and assuming a barrel length of about 30 inches, it will take the projectile about 0.001 seconds to clear the barrel. Assuming that barrel 112/212 accelerates to about 140 ft/sec (which is a function of the barrel's mass, assuming a very low coefficient of friction between the barrel and the sliding piston seal that supports it), the barrel will move about 1.7 inches in the time it takes the projectile to clear the barrel. Based on the aforementioned conditions, a gap of about 2 inches should be provided between the leading edge of broach 342 and arresting cartridge 332.

In the example depicted in FIG. 5, the distance between broach surfaces 342 and arresting cartridge 332 is set so that 2 milliseconds elapses as the forward cutting surface of broach 342 engages the arresting cartridge.

At time 0, the propellant is ignited and the projectile accelerates through the barrel. Barrel 112/212 moves leftward responsive to the recoil load. The second image depicts the system at 2.0 milliseconds, as broach 342 is about to engage arresting cartridge 332. At this point, the barrel is at its maximum velocity (for this example) of about 140 ft/sec.

The third image depicts the system at 2.7 milliseconds, which is 0.7 milliseconds after broach 342 engages arresting cartridge 332. At this point in time, the barrel's velocity has decreased from about 140 ft/sec to about 95 ft/sec. The fourth image depicts the system at 4 milliseconds, which is 2 milliseconds after engagement. At this point in time, broach 342 has cut through more than 50 percent of the (length of) arresting cartridge 332, and the barrel's velocity is down to about 60 feet per second. The final image depicts the system at 6 milliseconds, which is 4 milliseconds after engagement of the broach with the arresting cartridge. Cutting surfaces 352 of the broach have progressed more than two-thirds of the way through arresting cartridge 332 and the barrel has effectively stopped, the full recoil load having been transferred to the UUV.

It is notable that as the hull of the UUV receives the recoil load, the UUV is accelerated "backwards," which will be further from projectile's target. This is, of course, advantageous from the perspective of the survivability of the UUV, since the stand-off distance of the UUV from the target is often only a few meters.

The length of arresting cartridge 332, or the material from which it is made, can be adjusted to control the extent to which the barrel is slowed. For a barrel having a length of about 30 inches, and for the conditions describe above, the recoil stroke (maximum travel of the barrel) will be about 4-5 inches.

It is to be understood that the disclosure describes a few embodiments and that many variations of the invention can easily be devised by those skilled in the art after reading this disclosure and that the scope of the present invention is to be determined by the following claims.

What is claimed:

1. An apparatus comprising a broach recoil mechanism, wherein the broach recoil mechanism mitigates effects of a recoil load on a weaponized unmanned underwater vehicle (UUV), the broach recoil mechanism comprising:

a broach, wherein the broach comprises a plurality of cutting surfaces of increasing height disposed on an external surface of a barrel of the weaponized UUV;

an arresting cartridge, the arresting cartridge comprising a material suitable for broaching via the broach;

a sleeve, wherein the sleeve receives the arresting cartridge, and the sleeve and arresting cartridge are concentrically arranged with respect to the barrel, and suitably dimensioned so that the barrel moves longitudinally therethrough when a projectile is fired from the barrel; and a recoil load-bearing collar, wherein the recoil load-bearing collar is physically coupled to the sleeve and to a hull of the UUV, the recoil load-bearing collar thereby transferring the recoil load of the barrel to the hull.

2. The apparatus of claim 1, and further wherein the arresting cartridge comprises two symmetrical portions.

3. The apparatus of claim 1, and further wherein the arresting cartridge comprises plastic.

4. The apparatus of claim 1, and further wherein prior to firing of the projectile, a leading edge of the broach is spaced a first distance from the arresting cartridge, wherein the first distance is based on a length of the barrel, a muzzle velocity of the projectile, and an initial velocity of the barrel upon firing the projectile.

5. The apparatus of claim 1, wherein the apparatus comprises the weaponized UUV, the weaponized UUV having a barrel that is free to slide in the direction of a long axis of the barrel when a projectile is fired therefrom.

6. The apparatus of claim 5 wherein a breech of the barrel is accessible from a tail of the UUV.

7. An apparatus comprising a broach recoil mechanism, wherein the broach recoil mechanism mitigates effects of a recoil load on a weaponized unmanned underwater vehicle (UUV), the broach recoil mechanism comprising:

a broach, wherein the broach comprises a plurality of cutting surfaces of increasing height disposed on an external surface of a barrel of the weaponized UUV;

an arresting cartridge, the arresting cartridge comprising a material suitable for broaching via the broach, wherein the arresting cartridge is supported in a fixed position with respect to the barrel, and wherein:

when a projectile is fired from the barrel, the barrel moves longitudinally in a direction opposite to a direction of travel of the projectile, and wherein, after an amount of travel of the barrel that provides sufficient time for the projectile to exit the barrel, the cutting surfaces of the broach engage the arresting cartridge, causing the barrel to slow due to broaching of the arresting cartridge and a transfer of the recoil load from the barrel to the UUV.

8. The apparatus of claim 7, and further wherein the arresting cartridge comprises two symmetrical portions.

9. The apparatus of claim 7, and further wherein the arresting cartridge comprises plastic.

10. The apparatus of claim 7, and further wherein a breech of the barrel is accessible from a tail of the UUV.

11. A method for transferring a recoil load from a barrel of weapon in a weaponized unmanned underwater vehicle (UUV), the method comprising:

sliding a barrel towards an arresting cartridge in response to firing a projectile from the barrel, the barrel having a plurality of cutting surfaces of increasing height disposed on an exterior surface thereof; and engaging the cutting surfaces and the arresting cartridge, the arresting cartridge coupled to a hull of the UUV, engagement of the cutting surfaces and the arresting cartridge causing the barrel to decelerate and the UUV to accelerate as the recoil load is transferred from the barrel to the UUV, and wherein before the cutting surfaces and the arresting cartridge engage one another, the barrel moves a first distance that provides sufficient time for the projectile to exit the barrel before the cutting surfaces and the arresting cartridge engage one another.

* * * * *